United States Patent [19]

Schild et al.

[11] Patent Number: 4,743,210

[45] Date of Patent: May 10, 1988

[54] PASS-THROUGH TERMINAL ARRANGEMENT

[75] Inventors: Wolfgang Schild, Herford; Horst Conrad, Detmold, both of Fed. Rep. of Germany

[73] Assignee: C. A. Weidmüller GmbH & Co., Detmold, Fed. Rep. of Germany

[21] Appl. No.: 931,334

[22] Filed: Nov. 17, 1986

[30] Foreign Application Priority Data

Nov. 21, 1985 [EP] European Pat. Off. ..... 85114819.7

[51] Int. Cl.[4] ..... H01R 13/73

[52] U.S. Cl. ..... 439/559; 439/562

[58] Field of Search ..... 439/275, 281, 283, 544–546, 439/548–550, 556, 559, 562, 563, 569, 572, 574, 575, 709–722

[56] References Cited

U.S. PATENT DOCUMENTS

| | | | |
|---|---|---|---|
| 3,388,368 | 6/1968 | Sauber | 439/559 |
| 4,179,179 | 12/1979 | Lowden | 439/559 |
| 4,407,042 | 10/1983 | Schramme et al. | 439/562 |
| 4,532,574 | 7/1985 | Reiner et al. | 439/544 |
| 4,669,793 | 6/1987 | Hayashi et al. | 439/559 |

*Primary Examiner*—Gil Weidenfeld
*Assistant Examiner*—Paula A. Austin
*Attorney, Agent, or Firm*—Erwin S. Teltscher

[57] ABSTRACT

A pass-through terminal arrangement to be mounted on and extended through a mounting opening of a wall of a casing in a mounted position thereof includes a plurality of terminals each of which includes a terminal housing and a current bar having a projecting portion which extends out of the terminal housing and, in the mounted position, through the mounting opening into the interior of the casing. A sealing component is mounted on and surrounds a section of the projecting portion of each of the current bars. The terminal housings are connected in a row to a flange frame of a mounting flange which further includes a pass-through block rigid with the flange frame, at least partially received in the mounting opening in the mounted position, and having a plurality of pass-through openings each for sealingly accommodating at least the section of one of the current bars and the sealing component mounted thereon. The mounting frame is secured to the wall, and a seal is interposed between the flange frame and the wall in the mounted position.

8 Claims, 4 Drawing Sheets

PASS-THROUGH TERMINAL ARRANGEMENT

BACKGROUND OF THE INVENTION

The present invention relates to electrical terminals in general, and more particularly to a pass-through terminal arrangement which is to be mounted on and passed through an opening of a wall, such as that of a casing.

There is already known a variety of constructions of pass-through terminal arrangements, among them such which include a plurality of individual terminals which are arranged in a row and each of which includes a current bar which extends through a mounting opening provided in a wall of a box, a casing or the like, which will be collectively referred to herein as a casing, into the interior of the casing. Substantially no problems are encountered in the heretofore known pass-through terminal arrangement constructions so long as the internal space of the casing need not be particularly sealed or insulated with respect to the exterior. On the other hand, the heretofore known constructions of pass-through terminal arrangements are not particularly suited for use in situations where a high degree of a sealing and/or insulating effect is required.

SUMMARY OF THE INVENTION

Accordingly, it is a general object of the present invention to avoid the disadvantages of the prior art.

More particularly, it is an object of the present invention to provide a pass-through terminal arrangement which does not possess the drawbacks of the known arrangements of this type.

Still another object of the present invention is to devise an arrangement of the type here under consideration which is particularly suited for use in applications where a high degree of sealing and/or insulation is required or desirable.

It is yet another object of the present invention to design the above arrangement in such a manner as to provide for an easy installation thereof without sacrificing the desired sealing and/or insulating effect.

A concomitant object of the present invention is so to construct the arrangement of the above type as to be relatively simple in construction, inexpensive to manufacture, easy to use, and yet reliable in operation.

In keeping with these objects and others which will become apparent hereafter, one feature of the present invention resides in a pass-through terminal arrangement to be mounted on and extended through a mounting opening of a wall of a casing in a mounted position thereof. The arrangement of the present invention comprises a plurality of terminals each including a terminal housing and a current bar having a projecting portion which extends out of the terminal housing and, in the mounted position, through the mounting opening into the interior of the casing. A respective one of a plurality of sealing components is mounted on and surrounds a section of the projecting portion of one of the current bars. The arrangement further includes a mounting flange including a flange frame and a pass-through block rigid with the flange frame, at least partially received in the mounting opening in the mounted position, and having a plurality of pass-through openings each for sealingly accommodating at least the section of one of the current bars and the sealing component mounted thereon. There are further provided means for connecting the plurality of terminal housings in a row to the flange frame, means for securing the mounting frame to the wall in the mounted position, and sealing means interposed between the flange frame and the wall in the mounted position.

Owing to the construction of the pass-through terminal arrangement as described so far, it is possible to achieve a passage of the current bars through the wall which fully seals and/or insulates the interior of the casing with respect to the exterior, inasmuch as the current bars on their part can be received with their sealing components in a sealed manner in the associated pass-through openings of the pass-through block, while the mounting flange can be mounted on the wall in a manner which is completely sealed at the outside of the pass-through block by the circumferentially extending sealing means. What is also important herein is the reliable holding of the terminal housings which are arranged in a row on the flange frame, which thus also simultaneously serves as a holder for the terminals. This significantly contributes to a pronounced simplicity of the construction and to the simplicity of installation of this arrangement.

Advantageously, the connecting means includes a flange frame portion of the mounting flange and a T-shaped groove on a rear portion of each of the terminal housings, the groove receiving and engaging the flange frame portion upon sliding the respective terminal housing onto the flange frame portion, and each of the terminal housings includes a laterally open insertion opening at the rear portion for lateral insertion of the respective current bar thereinto.

It is particularly advantageous when each of the sealing components includes a cylindrical element of a synthetic plastic material and a sealing ring carried by the cylindrical element, and when each of the pass-through openings in the pass-through block has a configuration fitted to the sealing component. Then, it is further advantageous when the pass-through block further includes in each of its pass-through openings a partitioning wall serving as an abutment and having a pass-through slot for the current bar. It is also advantageous when the pass-through block has a free end portion extending into the casing in the mounted position and is provided with lateral slots at the region of the free end portion, and the securing means includes a rapid-connection buckle inserted into the lateral slots in the mounted position.

According to another advantageous facet of the present invention, the pass-through block is offset and includes a smaller central portion and an enlarged shoulder portion surrounding the central portion and having rearwardly open screw-receiving openings, and the securing means includes a connecting plate having an opening for receiving the central portion, and a plurality of connecting screws for connecting the connecting plate to the pass-through block by being threaded into the screw-receiving openings. Advantageously, the mounting flange includes a circumferentially extending groove between the shoulder portion and the flange frame, and the sealing means includes a circumferentially extending seal received in the groove.

In accordance with a further aspect of the present invention, the securing means includes angular portions on respective rear portions of the terminal housing, and a plurality of connecting screws which connect the angular portions to the flange frame of the mounting frame to form an assembly therewith. It is particularly advantageous when the mounting flange includes an inner flange frame portion having rearwardly open internally threaded bushings for connecting screws provided therein, and when the sealing means includes a circumferentially extending seal arranged on the inner flange frame portion and having openings for the passage of the connecting screws there-through.

It may be appreciated from the above description of the structural features of the pass-through terminal arrangement of the present invention that, depending on the particular construction chosen, especially on the manner in which the terminal housings are connected to the flange frame of the mounting flange, for instance, the terminals with the current bars, the connecting elements and the terminal housings can be mounted on the mounting flange one after the other in the row, until there is obtained a firm and compact structural unit which is then mounted on the wall merely by introducing the pass-through block into the mounting opening provided therefor in the wall and by securing the mounting flange in the mounted position after the circumferentially extending sealing means has been interposed between the mounting flange and the wall. When the structure and configuration of the connecting elements which connect the terminal housings to the mounting flange frame are chosen correspondingly, the individual terminals with the current bars can also be pre-assembled as respective terminal units, and these terminal units can then be structurally united with the mounting flange while simultaneously introducing the current bars and their sealing components into the pass-through block, after which the so formed structural unit or assembly is again rigidly mounted on the wall of the casing after the pass-through block as been introduced into the mounting opening of the wall to project into the interior of the casing.

BRIEF DESCRIPTION OF THE DRAWING

The present invention will be described below in more detail with reference to the accompanying drawing in which.

DETAILED DESCRIPTION OF THE PREFERRED EMBODIMENT

Figure 1:
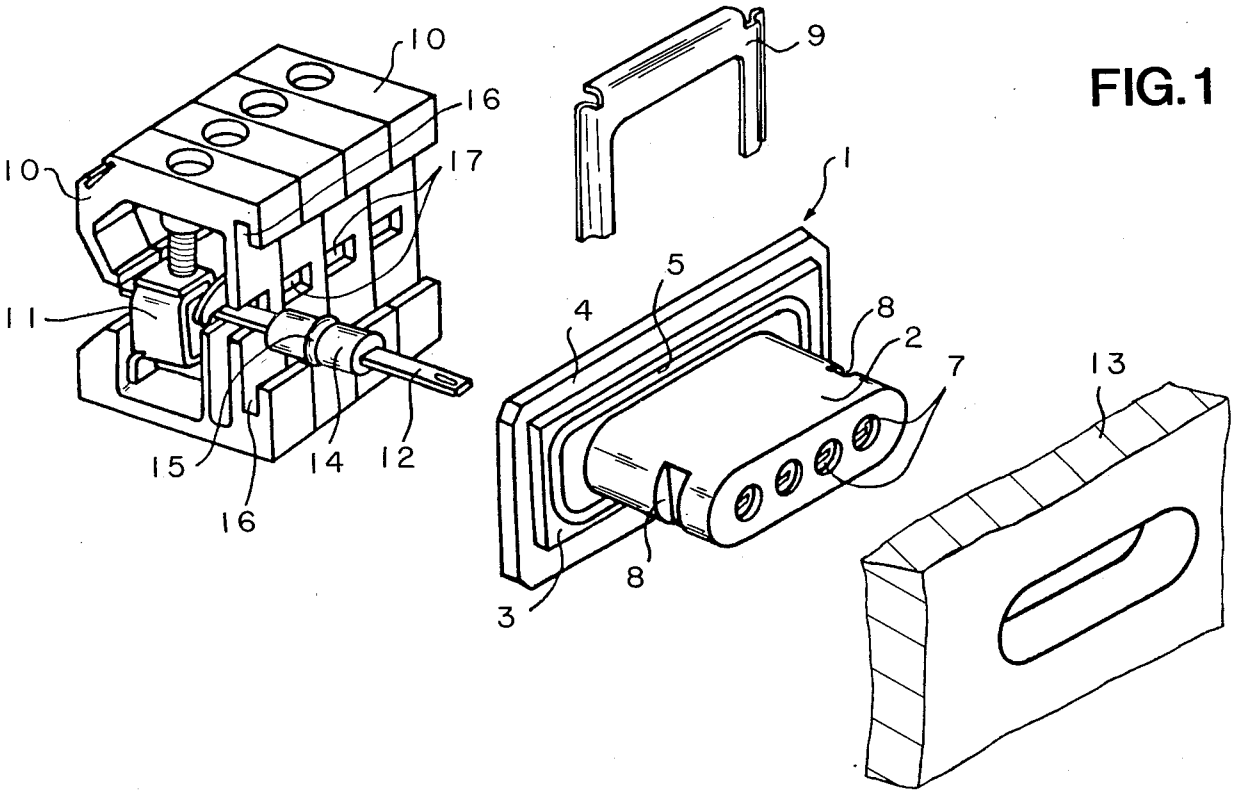
FIG. 1 is an exploded view of a pass-through terminal arrangement according to the present invention.
Figure 2:
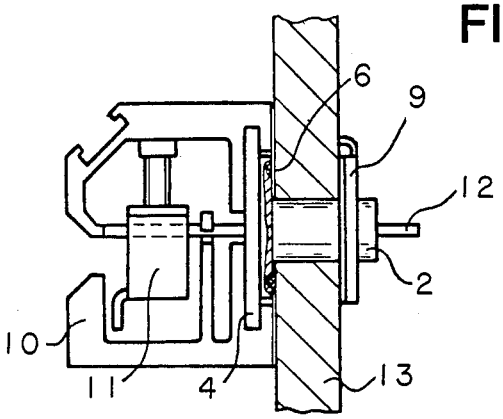
FIG. 2 is a somewhat simplified sectional view of the pass-through terminal arrangement of FIG. 1 in its mounted position on a wall.

Referring now to the drawing in detail, and first to FIGS. 1 and 2 thereof, it may be seen that the reference numeral 1 has been used therein to identify a mounting flange member of a pass-through terminal arrangement according to the present invention. The mounting flange member 1 includes a pass-through block 2 which is provided at one of its ends with a flange frame that has a recessed configuration and consists of an inner frame portion 3 and an outer frame portion 4. In the inner frame portion 3, there is provided a circumferentially extending groove 5 for the accommodation of a circumferentially extending seal 6, for instance a circumferentially extending foam rubber seal. For the sake of clarity, the circumferentially extending seal 6, which is to be received in the circumferentially extending groove 5, has been omitted from the exploded view of FIG. 1. However, this seal 6 is shown in FIG. 2 of the drawing.

In the pass-through block 2, there is provided, in dependence on the number of current bars to be accepted, a corresponding number of pass-through openings 7. Furthermore, in this particular construction, insertion slots 8 for the reception of a rapid-connection buckle 9 are provided laterally on the pass-through block 2.

In this particular pass-through terminal arrangement construction, the terminals include terminal housings 10 which are constructed and configured in such a manner that they can be arranged in a row next to one another and each of which accommodates in its interior a respective clamping yoke connector 11. Each clamping yoke connector 11, in turn, is mounted on a respective current bar 12. The current bars 12 are to be conducted by means of the above-mentioned mounting flange member 1 through a wall 13 of a box, casing or the like into the interior of the latter in a manner which fully insulates the interior of the box or casing with respect to the exterior. The current bars 12 carry respective sealing components each of which includes a cylindrical element 14 of synthetic plastic material, which is injection-molded onto the respective current bar 12, and a sealing ring 15 which is carried by the cylindrical element 14.

In this particular construction, the terminal housings 10 are provided at their rear portions with T-shaped grooves 16 which extend transversely on the current bars 12 in the direction of the row and which serve for receiving the outer flange frame 4. The terminal housings 10 are further provided at the bottoms of these grooves 16 with insertion openings 17 which are open to one side and serve for rearward passage of the current bars 12 therethrough.

Having so described the construction of the pass-through terminal arrangement of the present invention with reference to FIGS. 1 and 2, the assembly and/or installation will now be explained in context. Initially, the current bar 12 of the first terminal in the row is introduced into the corresponding passage opening 7 of the pass-through block 2 of the mounting flange 1. In this connection, it is to be mentioned that the configuration of this pass-through opening 7 over its course is exactly fitted to that of the current bar 12 inclusive of the sealing component (14, 15) formed thereon, in such a manner that a full sealing effect is obtained during the introduction of the current bar 12 carrying the sealing component (14, 15) into the pass-through opening 7 while the sealing ring 15 is slightly correspondingly deformed on the cylindrical element 14 of synthetic plastic material. Herein, the pass-through opening 7 is advantageously further provided in its interior with a small partitioning wall 18 which is provided with a pass-through slot 19 for the passage of the metallic part of the current bar 12, in the manner illustrated in FIG. 3 of the drawing. As a result of this particular construction, there is further obtained a contact in the manner of an abutment between the end wall of the cylindrical synthetic material element 14 and the partitioning wall 18. This not only defines the exact insertion depth of the current bar 12, but also additionally contributes to the sealing effect by forming a labyrinthine flow path.

The corresponding clamping yoke 11 is positioned on the respective current bar 12 and the corresponding terminal housing 10 is then slid from the side over the mounting flange 1 in such a manner that the flange frame (3,4) is received and the outer frame portion 4 engages in the T-shaped groove 16, until the corresponding portion of the current bar 12 enters and is fully received in the insertion opening 17. The following terminals are then mounted one after the other on the mounting flange 1 in exactly the same manner as described above. Then, when the mounting flange 1 is equipped with all of the provided terminals, and after the circumferentially extending seal 6 is inserted into the groove 5, the whole structural unit or assembly is mounted on the wall 13 of the casing by inserting the pass-through block 2 into a mounting opening in the wall 13. Then, the rapid-connection buckle 9 is inserted into the insertion slots 8 of the pass-through block 2 in the interior of the casing. In this respect, the arrangement is chosen in such a manner that, upon the insertion of the rapid-connection buckle 9, the inner flange frame portion 3 firmly engages the outer surface of the wall 13 while the circumferentially extending seal 6, which has extended slightly out of the groove 5 prior to the mounting of the structural unit on the wall 13, is slightly deformed.

Figure 4:
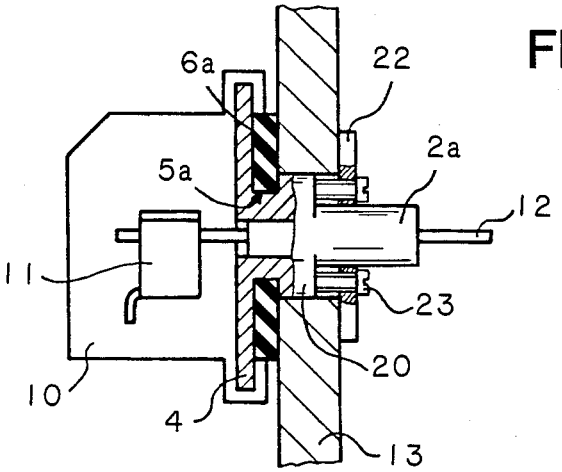
FIG. 4 is a view corresponding to FIG. 2 but of the modified construction of FIG. 3.
Figure 3:
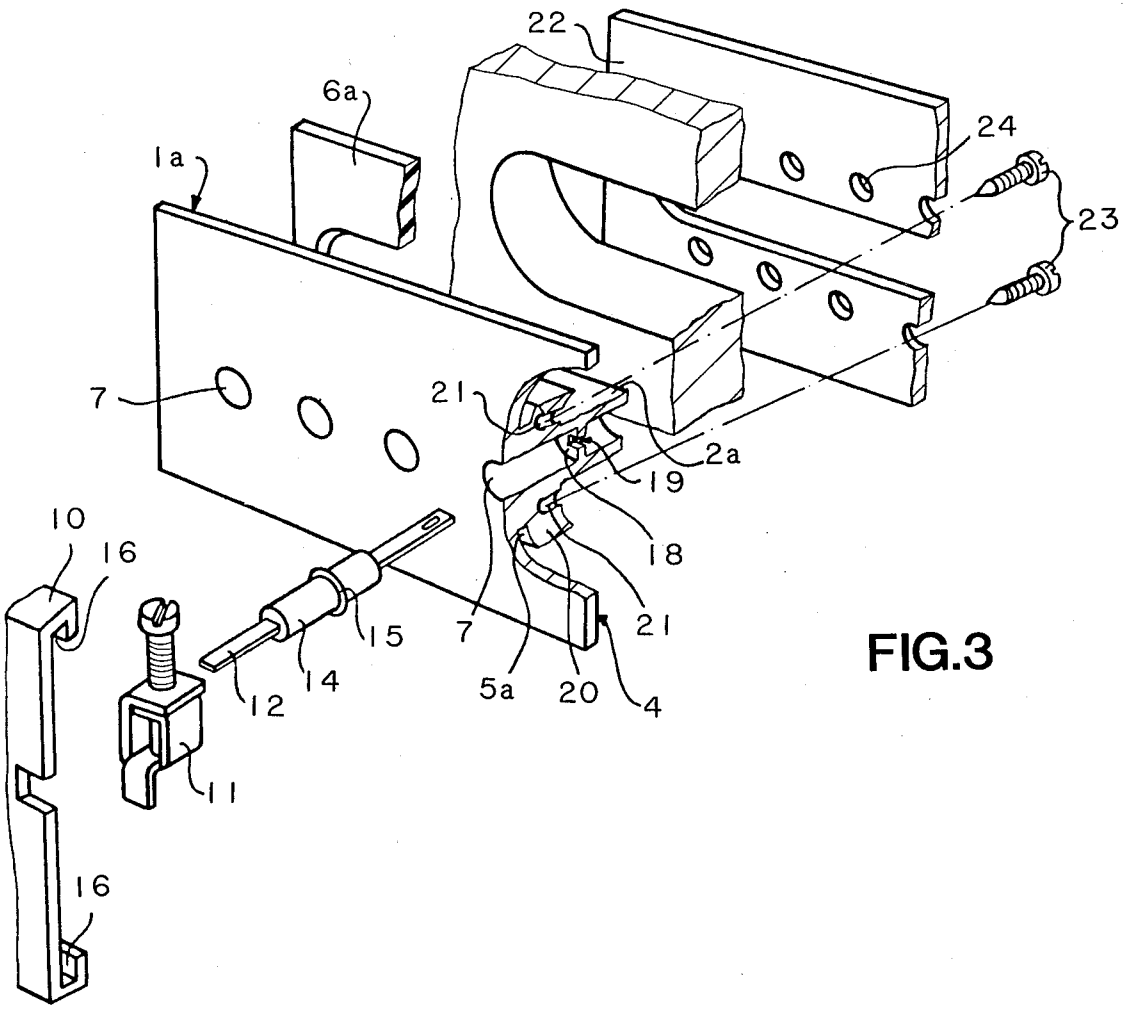
FIG. 3 is a view similar to FIG. 1 but showing a modified construction of the pass-through terminal arrangement of the present invention.

Turning now to FIGS. 3 and 4 of the drawing, it may be seen that they depict a slightly modified construction of the pass-through terminal arrangement of the present invention which basically has the same structure as the arrangement discussed above, so that the same or similar reference numerals have been used to identify the same or corresponding parts. Yet, this modified construction slightly differs from the above-discussed construction, basically in the manner in which the mounting flange, which in this instance is identified by the reference numeral 1*a*, is affixed to the wall 13. In this modified construction, the mounting flange 1*a* is provided with an offset pass-through block 2*a* which is again provided in its interior with the pass-through openings 7 that serve for sealingly receiving the current bars 12 inclusive of the respective sealing component (14,15) thereof. However, the pass-through block 2*a* is further provided at its periphery with an enlarged shoulder portion 20 which is provided with screw-receiving bores 21 that are open toward the rear.

The flange frame of the mounting flange 1*a* in this case has only the outer frame portion 4 which is continuous and which is capable of cooperating with the rearward T-shaped grooves 16 of the terminal housings 10. A circumferentially extending groove 5*a* is formed between the enlarged shoulder portion 20 of the pass-through block 2*a* and the flange frame portion 4, and a circumferentially extending seal 6*a* can be inserted into this groove 5*a*.

In this construction, the terminals are again mounted on the mounting flange 1*a* one after the other by means of the current bars 12 in the same manner as described above in conjunction with the construction illustrated in FIGS. 1 and 2 of the drawing. Then, the pass-through block 2*a* of the mounting flange 1*a* which has been already equipped with the terminals is inserted into the corresponding opening of the wall 13 and the securing of the entire structural unit or assembly to the wall 13 is in this construction accomplished in such a manner that a connecting plate 22 is slid in the interior of the casing over the smaller section of the pass-through block 2*a* which projects into the interior of the casing, until it abuts the internal surface of the wall 13. The securing of the structural assembly in position is then accomplished by means of screws 23, the stems of which are inserted through respective openings 24 of the connecting plate 22 and threaded into the screw-receiving bores 21 of the shoulder portion 20 of the pass-through block 2*a*. In this instance, there is also obtained during the tightening of the screws 23 the desired compression of the seal 6*a*, which results in a sealing effect with respect to the exterior of the casing. When the screws 23 are provided with self-cutting threads, the screw-receiving bores 21 themselves need not be internally threaded to begin with.

Figure 5:
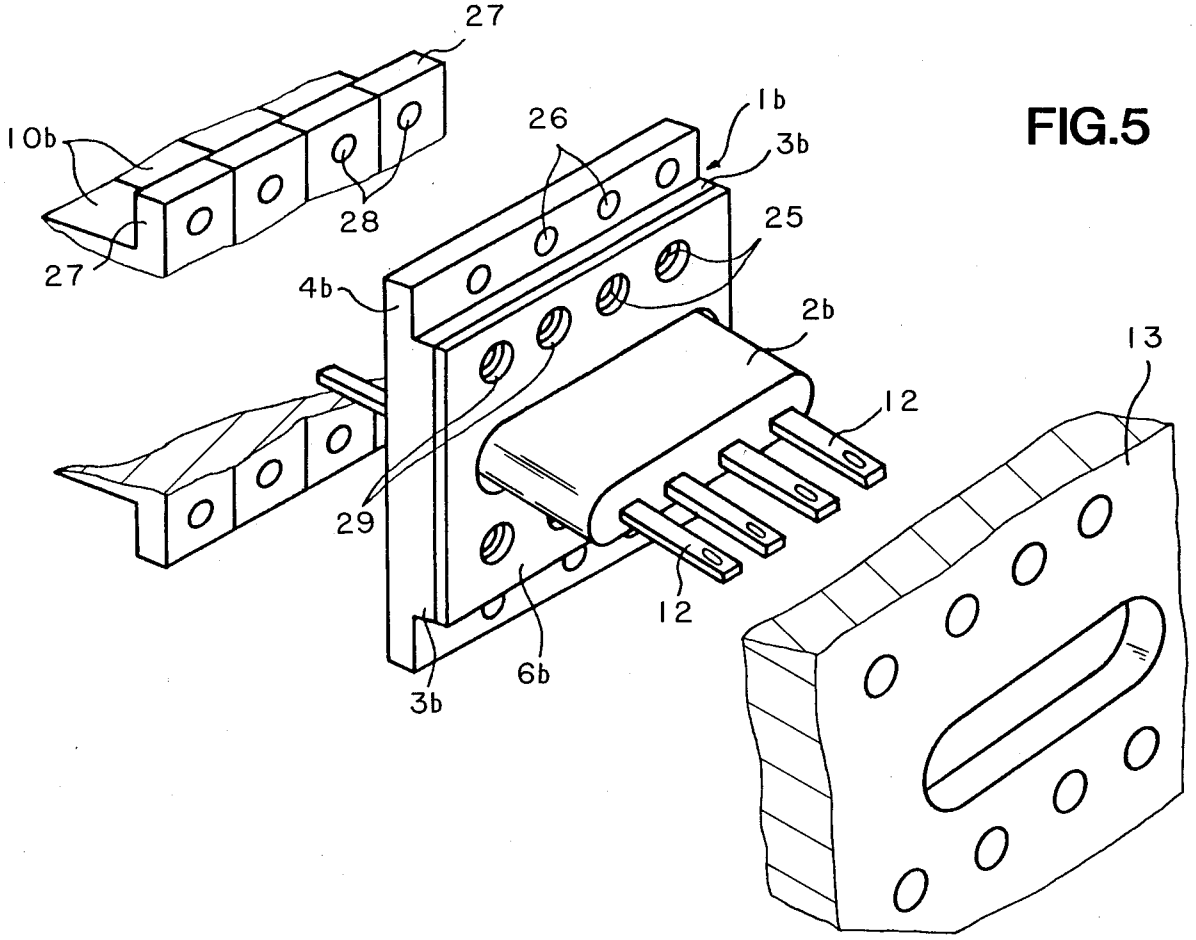
FIG. 5 is a somewhat simplified view similar to FIG. 1 but showing a further modification of the construction of the pass-through terminal arrangement of the present invention.

FIG. 5 of the drawing, in which the same convention as before is being observed with respect to the assignment of reference numerals, depicts a further modification of the construction of the arrangement according to the present invention, in which there is provided a mounting flange 1*b* that includes an offset flange frame (3*b*, 4*b*)consisting of an inner frame portion 3*b* and an outer frame portion 4*b*. Threaded bushings 25 are so inserted into the inner frame portion 3*b* that they are open in the rearward direction, while the outer frame portion 4*b* is provided with bores 26 for connecting screws. A circumferentially extending seal 6*b* may be provided at the rear side of the inner flange frame portion 3*b* which faces the wall 13. The seal 6*b* surrounds the pass-through block 2*b* of the mounting flange 1*b*, in which there are again to be accommodated, in the above-discussed manner, the current bars 12 so as to obtain a sealed arrangement. As indicated in FIG. 5, in this particular construction, the terminal housings 10*b*, instead of having the T-shaped grooves discussed above in conjunction with FIGS. 1 to 3 of the drawing, are provided with small angular portions 27 formed thereon. The angular portions 27 extend in the upward and downward directions, respectively and are provided with bores 28 for connecting screws.

In this particular construction, the terminal housings 10*b*, together with the clamping yokes accommodated and held therein, are mounted as respective structural units on the respective current bars 12 which have been previously inserted into the mounting flange 1*b*, and then the angular portions 27 of the housings 10*b* are connected with the outer frame portions 4*b* by respective screws. The seal 6*b*, which is provided at its regions that correspond to the threaded bushings 25 with through openings 29, is then assembled with the thus formed structural unit or assembly, and is subsequently introduced into the corresponding opening of the wall 13 of the casing. In this instance, the wall 13 is further provided with through openings, through which the connecting screws can be introduced from the interior of the casing. These connecting screws are then threaded into the threaded bushings 25 and they themselves then secure the inner flange frame portion 3*b* in position with respect to the wall 13 while also causing deformation of the circumferentially extending seal 6*b*.

While the present invention has been described and illustrated herein as embodied in certain specific constructions of a pass-through terminal arrangement, it is not limited to the details of these particular constructions, since various modifications and structural changes are possible and contemplated by the present invention. Thus, the scope of the present invention will be determined exclusively by the appended claims.

What is claimed is:

1. A pass-through terminal arrangement to be mounted on and extend through a mounting opening of a wall of a casing in a mounted position thereof, comprising a plurality of terminals each including a terminal housing and a current bar having a projecting portion which extends out of said terminal housing and, in the mounted position, through the mounting opening into the interior of the casing;

a plurality of sealing components each mounted on and surrounding a section of said projecting portion of one of said current bars;

a mounting flange including a flange frame and a pass-through block rigid with said flange frame, at least partially received in the mounting opening in the mounted position, and having a plurality of pass-through openings each for sealingly accommodating at least said section of one of said current bars and said sealing component mounted thereon, means for connecting said plurality of terminal housings in a row to said flange frame;

means for securing said mounting frame to the wall in the mounted position; and sealing means interposed between said flange frame and the wall in the mounted position.

2. The terminal arrangement as defined in claim 1, wherein said connecting means includes a flange frame portion of said mounting flange and a T-shaped groove on a rear portion of each of said terminal housings, said groove receiving and engaging said flange frame portion upon sliding the respective terminal housing onto said flange frame portion; and wherein each of said terminal housings includes a laterally open insertion opening at said rear portion for lateral insertion of the respective current bar thereinto.

3. The terminal arrangement as defined in claim 1, wherein each of said sealing components includes a cylindrical element of a synthetic plastic material and a sealing ring carried by said cylindrical element; wherein each of said pass-through openings in said pass-through block has a configuration fitted to said sealing component; and wherein said pass-through block further includes in each of said pass-through openings thereof a partitioning wall serving as an abutment and having a pass-through slot.

4. The terminal arrangement as defined in claim 1, wherein said pass-through block has a free end portion extending into the casing in the mounted position and is provided with lateral slots at the region of said free end portion; and wherein said securing means includes a rapid-connection buckle inserted into said lateral slots in the mounted position.

5. The terminal arrangement as defined in claim 1, wherein said securing means includes angular portions on respective rear portions of said terminal housing, and a plurality of connecting screws which connect said angular portions to said flange frame of said mounting frame to form an assembly therewith.

6. The terminal arrangement as defined in claim 1, wherein said mounting flange includes an inner flange frame portion having rearwardly open internally threaded bushings for connecting screws provided therein; and wherein said sealing means includes a circumferentially extending seal arranged on said inner flange frame portion and having openings for the passage of the connecting screws therethrough.

7. The terminal arrangement as defined in claim 1, wherein said pass-through block is offset and includes a smaller central portion and an enlarged shoulder portion surrounding said central portion and having rearwardly open screw-receiving openings; and wherein said securing means includes a connecting plate having an opening for receiving said central portion, and a plurality of connecting screws for connecting said connecting plate to said pass-through block by being threaded into said screw-receiving openings.

8. The terminal arrangement as defined in claim 7, wherein said mounting flange includes a circumferentially extending groove between said shoulder portion and said flange frame; and wherein said sealing means includes a circumferentially extending seal received in said groove.

* * * * *